US009990895B2

(12) United States Patent
Lin et al.

(10) Patent No.: US 9,990,895 B2
(45) Date of Patent: Jun. 5, 2018

(54) DISPLAY APPARATUS AND DRIVING METHOD OF DISPLAY PANEL THEREOF

(71) Applicant: GIANTPLUS TECHNOLOGY CO., LTD, Miaoli County (TW)

(72) Inventors: Yu-Yen Lin, Hsinchu (TW); Hou-Hong Li, Yilan County (TW)

(73) Assignee: GIANTPLUS TECHNOLOGY CO., LTD, Miaoli County (TW)

( * ) Notice: Subject to any disclaimer, the term of this patent is extended or adjusted under 35 U.S.C. 154(b) by 0 days. days.

(21) Appl. No.: 15/352,597

(22) Filed: Nov. 16, 2016

(65) Prior Publication Data

US 2017/0352320 A1 Dec. 7, 2017

(30) Foreign Application Priority Data

Jun. 2, 2016 (TW) ..... 105117306 A

(51) Int. Cl.
*G09G 3/36* (2006.01)

(52) U.S. Cl.
CPC ..... *G09G 3/3677* (2013.01); *G09G 3/3655* (2013.01); *G09G 2300/0852* (2013.01); *G09G 2310/08* (2013.01)

(58) Field of Classification Search
CPC ..... G09G 3/3677; G09G 3/3655; G09G 2300/0852; G09G 2310/08
USPC ..... 345/212
See application file for complete search history.

(56) References Cited

U.S. PATENT DOCUMENTS 5,903,249 A * 5/1999 Koyama ..... G09G 3/3659 345/92
7,973,782 B2 7/2011 Itakura et al.
8,248,341 B2 8/2012 Neugebauer
2008/0123002 A1* 5/2008 Yeh ..... G02F 1/136286 349/37
2008/0211796 A1 9/2008 Kim
(Continued)

FOREIGN PATENT DOCUMENTS

| | | |
|---|---|---|
| CN | 101136177 | 3/2008 |
| CN | 102385835 | 3/2012 |
| TW | I263966 | 10/2006 |
| TW | 201214390 | 4/2012 |

OTHER PUBLICATIONS

"Office Action of Taiwan Counterpart Application", dated Oct. 4, 2016, p. 1-p. 4.

*Primary Examiner* — Amare Mengistu
*Assistant Examiner* — Gloryvid Figueroa-Gibson
(74) *Attorney, Agent, or Firm* — JCIPRNET

(57) ABSTRACT

A display apparatus and a driving method of a display panel thereof are provided. The display apparatus includes a gate driver circuit providing a plurality of gate driving signals, a switch driver circuit providing a plurality of switch driving signals and the display panel having a plurality of pixels arranged in an array. Each of the pixels includes a first switch, a second switch and a storage capacitor coupled in series, wherein the first switch is controlled by the corresponding switch driving signal, and the second switch is controlled by the corresponding gate driving signal. During a frame update period, the gate driving signals are enabled sequentially, and an enabling period of each of switch driving signal is overlapped with enabling periods of a part of gate driving signals. During an operation waiting period, the gate driving signals are enabled periodically.

11 Claims, 4 Drawing Sheets

(56) References Cited

U.S. PATENT DOCUMENTS

| | | | | |
|---|---|---|---|---|
| 2009/0079669 | A1* | 3/2009 | Huang | G09G 3/3677 345/30 |
| 2010/0020259 | A1 | 1/2010 | Park et al. | |
| 2011/0157125 | A1* | 6/2011 | Choi | H05B 33/0896 345/211 |
| 2013/0257914 | A1* | 10/2013 | Jung | G09G 3/348 345/690 |
| 2016/0063914 | A1* | 3/2016 | Lee | G09G 3/3648 345/211 |

* cited by examiner

DISPLAY APPARATUS AND DRIVING METHOD OF DISPLAY PANEL THEREOF

CROSS-REFERENCE TO RELATED APPLICATION

This application claims the priority benefit of Taiwan application serial no. 105117306, filed on Jun. 2, 2016. The entirety of the above-mentioned patent application is hereby incorporated by reference herein and made a part of this specification.

BACKGROUND OF THE INVENTION

Field of the Invention

The invention relates to a display technique, and particularly relates to a display apparatus and a driving method of a display panel thereof.

Description of Related Art

Along with quick development of display technology, people's life is more convenient with assistance of display apparatus, and in order to achieve light and thin features of the display apparatus, a flat panel display (FPD) becomes a mainstream in the market. Moreover, since a liquid crystal display (LCD) has features of a high space usage rate, low power consumption, no radiation and a low electromagnetic interference, etc., the LCD is well received by consumers.

In response to today's power saving requirement, in some of display applications, a refresh rate of the display apparatus is decreased to be below 30 Hz, i.e. pixels of a display panel are not refreshed for a period of time, and now a gate voltage of a transistor in each of the pixels is maintained to a turn-off voltage level during such period of time. However, since it may cause a stress phenomenon of the transistor to influence a display quality of the display panel when the gate voltage of the transistor is maintained to a same voltage level for a long time, the stress phenomenon has to be mitigated to improve the display quality of the display panel.

SUMMARY OF THE INVENTION

The invention is directed to a display apparatus and a driving method of a display panel thereof, which are adapted to suppress a switch stress of pixels therein.

The invention provides a display apparatus including a gate driving circuit, a switch driving circuit and a display panel. The gate driving circuit provides a plurality of gate driving signals. The switch driving circuit provides a plurality of switch driving signals. The display panel has a plurality of pixels arranged in an array. Each of the pixels includes a first switch, a second switch, a liquid crystal capacitor and a storage capacitor. A control terminal of the first switch receives a first switch driving signal of the switch driving signals, and a first terminal of the first switch is coupled to a data line. A control terminal of the second switch receives a first gate driving signal of the gate driving signals, and a first terminal of the second switch is coupled to a second terminal of the first switch. The liquid crystal capacitor and the storage capacitor are coupled in parallel between a second terminal of the second switch and a common voltage. During a frame update period, the gate driving signals are sequentially enabled, and an enabling period of each of the switch driving signals is overlapped with enabling periods of a part of the gate driving signals. During an operation waiting period, the gate driving signals are periodically enabled.

The invention provides a driving method of a display panel, where the display panel has a plurality of pixels arranged in an array, and each of the pixels has a first switch and a second switch connected in series. The driving method includes following steps. During a frame update period, a plurality of switch driving signals is enabled to turn on the first switches, and a plurality of gate driving signals is sequentially enabled to sequentially turn on the second switches, where an enabling period of each of the switch driving signals is overlapped with enabling periods of a part of the gate driving signals. During an operation waiting period, the gate driving signals are periodically enabled to periodically turn on the second switches.

According to the above description, in the display apparatus and the driving method of the display panel thereof, the switches in the pixel are periodically switched during the frame update period and the operation waiting period, so as to mitigate the stress phenomenon of the switch.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
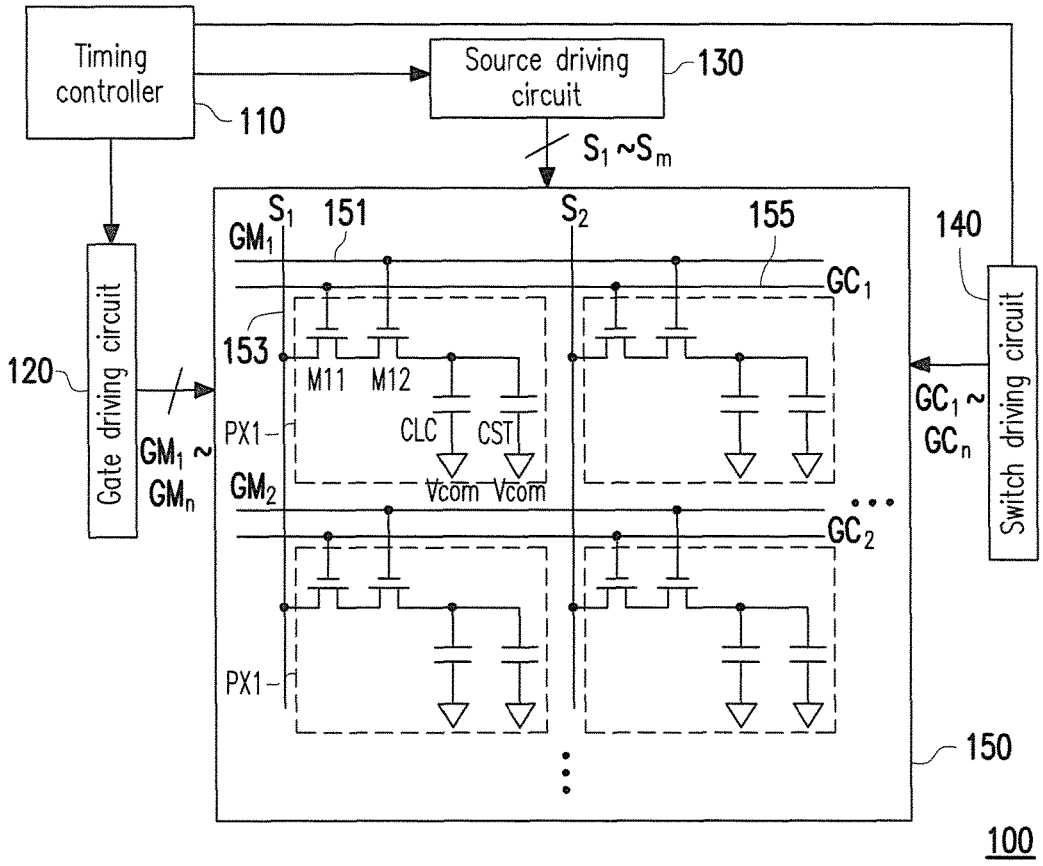
FIG. 1 is a system schematic diagram of a display apparatus according to an embodiment of the invention.

FIG. 1 is a system schematic diagram of a display apparatus according to an embodiment of the invention. Referring to FIG. 1, in the present embodiment, the display apparatus 100 includes a timing controller 110, a gate driving circuit 120, a source driving circuit 130, a switch driving circuit 140 and a display panel 150. The gate driving circuit 120 is coupled to the timing controller 110 and the display panel 150, and is controlled by the timing controller 110 to provide a plurality of gate driving signals $GM_1$-$GM_n$ to the display panel 150, where n is a positive integer. The source driving circuit 130 is coupled to the timing controller 110 and the display panel 150, and is controlled by the timing controller 110 to provide a plurality of source driving signals $S_1$-$S_m$ to the display panel 150, where m is a positive integer. Moreover, a frame update rate of the display panel is smaller than 30 Hz.

The switch driving circuit 140 is coupled to the timing controller 110 and the display panel 150, and is controlled by the timing controller 110 to provide a plurality of switch driving signals $GC_1$-$GC_n$ to the display panel 150. The display panel 150 has a plurality of gate lines 151, a plurality of source lines 153, a plurality of switch lines 155 and a plurality of pixels PX1 arranged in an array. Each of the pixels PX1 is coupled to the corresponding gate line 151, so as to receive the corresponding gate driving signal (for example, $GM_1$-$GM_n$, corresponding to the first gate driving signal) through the corresponding gate line 151. Each of the pixels PX1 is coupled to the corresponding source line 153, so as to receive the corresponding source driving signal (for example, $S_1$-$S_m$) through the corresponding source line 153. Moreover, each of the pixels PX1 is coupled to the corresponding switch line 155, so as to receive the corresponding switch driving signal (for example, $GC_1$-$GC_n$, corresponding to the first switch driving signal) through the corresponding switch line 155.

Each of pixels PX1 includes a first switch (which is, for example, implemented by a transistor M11), a second switch (which is, for example, implemented by a transistor M12), a liquid crystal capacitor CLC and a storage capacitor CST. A gate of the transistor M11 (corresponding to a control terminal of the first switch) receives the corresponding switch driving signal (such as $GC_1$-$GC_n$), and a source of the transistor M11 (corresponding to a first terminal of the first switch) is coupled to the corresponding source line 153. A gate of the transistor M12 (corresponding to a control terminal of the second switch) receives the corresponding gate driving signal (such as $GM_1$-$GM_n$), and a source of the transistor M12 (corresponding to a first terminal of the second switch) is coupled to a drain of the transistor M11 (corresponding to a second terminal of the first switch). The liquid crystal capacitor CLC and the storage capacitor CST are coupled in parallel between a drain of the transistor M12 (corresponding to a second terminal of the second switch) and a common voltage Vcom.

Figure 2:
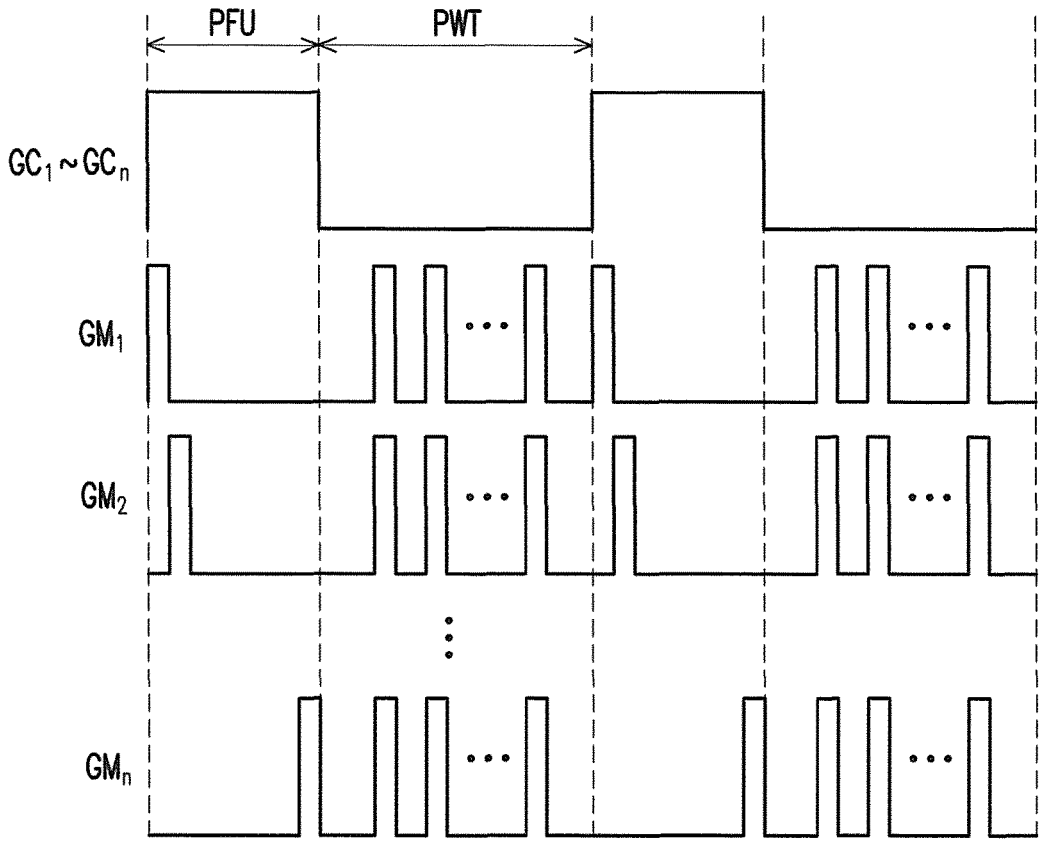
FIG. 2 is a waveform schematic diagram of switch driving signals and gate driving signals according to an embodiment of the invention.

FIG. 2 is a waveform schematic diagram of the switch driving signals and the gate driving signals according to an embodiment of the invention. Referring to FIG. 1 and FIG. 2, in the present embodiment, one frame period includes a frame update period PFU and an operation waiting period PWT. During the frame update period PFU, the timing controller 110 writes a display voltage to each of the pixels PX1 through the gate driving circuit 120, the source driving circuit 130 and the switch driving circuit 140. Further, during the frame update period PFU, the switch driving signals $GC_1$-$GC_n$ are simultaneously enabled to turn on the transistors M11 of all of the pixels PX1. Moreover, the gate driving signals $GM_1$-$GM_n$ are sequentially enabled to turn on the transistors M12 of all of the pixels PX1 row-by-row. When the transistors M11 and M12 of each of the pixels PX1 are all turned on, the display voltage is written into the liquid crystal capacitor CLC and the storage capacitor CST of each of the pixels PX1 through the source driving signals $S_1$-$S_m$.

Then, during the operation waiting period PWT, each of the pixels PX1 maintains a light transmittance (i.e. a gray level), i.e. the source driving circuit 130 does not transmit the display voltage through the source driving signals $S_1$-$S_m$, and the gate driving circuit 120 and the switch driving circuit 140 still operate to mitigate the stress phenomenon of the transistors M12 of all of the pixels PX1. Further, the switch driving signals $GC_1$-$GC_n$ can be simultaneously disabled, such that the voltages of the liquid crystal capacitor CLC and the storage capacitor CST of the pixel PX1 are not directly influenced by the source driving signals $S_1$-$S_m$, and the gate driving signals $GM_1$-$GM_n$ are periodically enabled to mitigate the stress phenomenon of the transistors M12, where enabling periods of the gate driving signals $GM_1$-$GM_n$ are completely overlapped, though the invention is not limited thereto.

In the present embodiment, the switch driving signals $GC_1$-$GC_n$ are simultaneously enabled and disabled, i.e. the switch driving signal $GC_1$-$GC_n$ can be regarded as a same switch driving signal, thought in other embodiments, the switch driving signals $GC_1$-$GC_n$ can be divided into several parts for respectively enabling and disabling, i.e. the switch driving signals $GC_1$-$GC_n$ can be regarded as a plurality of switch driving signals. For example, the switch driving signals $GC_1$-$GC_n$ are assumed to be divided into two parts (for example, an upper half part and a lower half part), i.e. the upper half part of the switch driving signals $GC_1$-$GC_n$ can be regarded as one switch driving signal, and the lower half part of the switch driving signals $GC_1$-$GC_n$ can be regarded as another switch driving signal, and during the frame update period PFU, the upper half part and the lower half part of the switch driving signals $GC_1$-$GC_n$ are sequentially enabled, i.e. the enabling period of each of the switch driving signals $GC_1$-$GC_n$ is overlapped with the enabling periods of a half of the gate driving signals $GM_1$-$GM_n$. During the operation waiting period PWT, the upper half part and the lower half part of the switch driving signals $GC_1$-$GC_n$ are simultaneously disabled. In this way, the driving method of the switch driving signals $GC_1$-$GC_n$ is simplified.

Moreover, in the present embodiment, the switch driving signals $GC_1$-$GC_n$ are maintained to be enabled during the frame update period PFU, and are maintained to be disabled during the operation waiting period PWT, so as to balance the stress phenomenon of the transistors M11 through positive stress and negative stress.

Figure 3:
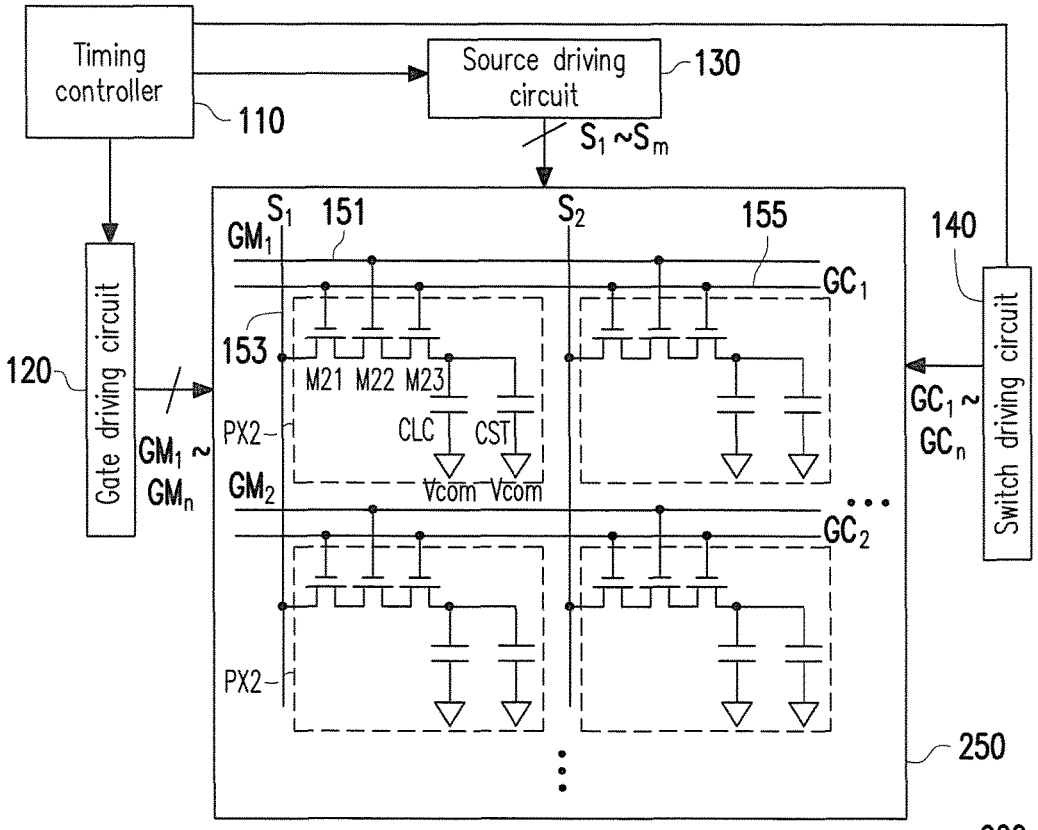
FIG. 3 is a system schematic diagram of a display apparatus according to another embodiment of the invention.

FIG. 3 is a system schematic diagram of a display apparatus according to another embodiment of the invention. Referring to FIG. 1 and FIG. 3, in the present embodiment, the display apparatus 200 is similar to the display apparatus 100, and a difference there between lies in pixels PX2 of a display panel 250, where the same or similar devices are denoted by the same or similar referential numbers. Further, each of the pixels PX2 includes a first switch (which is, for example, implemented by a transistor M21), a second switch (which is, for example, implemented by a transistor M22), a third switch (which is, for example, implemented by a transistor M23), a liquid crystal capacitor CLC and a storage capacitor CST.

A gate of the transistor M21 (corresponding to a control terminal of the first switch) receives the corresponding switch driving signal ($GC_1$-$GC_n$), and a source of the transistor M21 (corresponding to a first terminal of the first switch) is coupled to the corresponding source line 153. A gate of the transistor M22 (corresponding to a control terminal of the second switch) receives the corresponding gate driving signal ($GM_1$-$GM_n$), and a source of the transistor M22 (corresponding to a first terminal of the second switch) is coupled to a drain of the transistor M21 (corresponding to a second terminal of the first switch). A gate of the transistor M23 (corresponding to a control terminal of the third switch) receives the corresponding switch driving signal $GC_1$-$GC_n$, and a source of the transistor M23 (corresponding to a first terminal of the third switch) is coupled to a drain of the transistor M22 (corresponding to a second terminal of the second switch). The liquid crystal capacitor CLC and the storage capacitor CST are coupled in parallel between a drain of the transistor M23 (corresponding to a second terminal of the third switch) and a common voltage Vcom. In other words, compared with the pixel PX1, the pixel PX2 further includes the transistor M23, and the transistor M23 is coupled between the drain of the transistor M22 and the liquid crystal capacitor CLC and the storage capacitor CST connected in series.

Figure 4A:
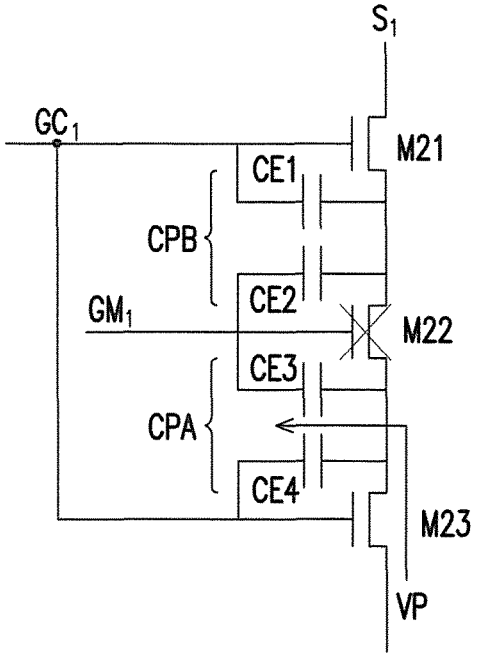
FIG. 4A to FIG. 4C are schematic diagrams of switch operations of a pixel according to another embodiment of the invention.
Figure 4B:
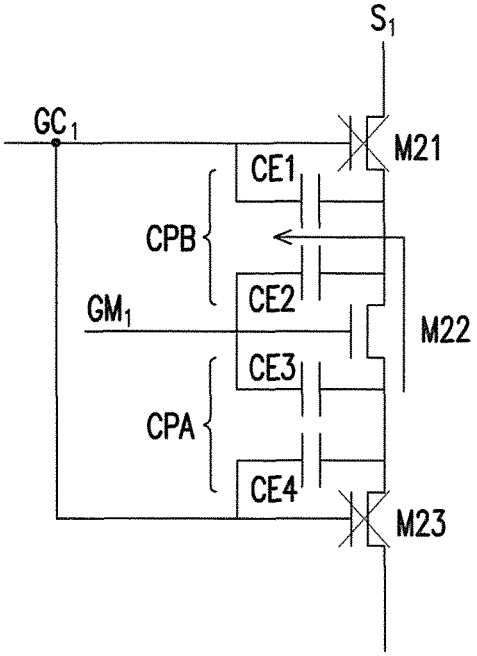
Figure 4C:
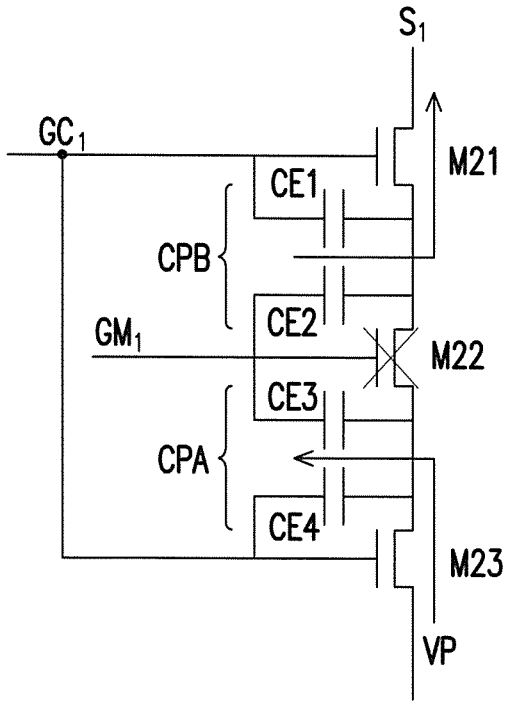

FIG. 4A to FIG. 4C are schematic diagrams of switch operations of the pixel according to another embodiment of the invention. Referring to FIG. 2, FIG. 3, and FIG. 4A to FIG. 4C, in the present embodiment, it is assumed that the pixel PX2 receives the gate driving signal $GM_1$, the switch driving signal $GC_1$ and the source driving signal $S_1$. Moreover, the transistor M21 forms an equivalent capacitor CE1, the transistor M22 forms equivalent capacitors CE2 and CE3, and the transistor M23 forms an equivalent capacitor CE4, where it is assumed that capacitances of the equivalent capacitors CE1-CE4 are all the same (which are represented by CE), the equivalent capacitors CE3 and CE4 connected in parallel can be regarded as a first capacitor portion CPA, and the equivalent capacitors CE1 and CE2 connected in parallel can be regarded as a second capacitor portion CPB.

When the gate driving signal $GM_1$ is disabled and the switch driving signal $GC_1$ is enabled, a voltage (represented by VP) on the liquid crystal capacitor CLC and the storage capacitor CST may charge the first capacitor portion CPA, and a charge amount QA on the first capacitor portion CPA is $QA=2\times CE\times VP$. Then, when the gate driving signal $GM_1$ is enabled and the switch driving signal $GC_1$ is disabled, the charge amount QA on the first capacitor portion CPA is shared to the second capacitor portion CPB, i.e. the charge amounts of the first capacitor portion CPA and the second capacitor portion CPB are respectively $QB=QA/2=CE\times VP$. Then, when the gate driving signal $GM_1$ is again disabled and the switch driving signal $GC_1$ is again enabled, the charges of the second capacitor portion CPB are transferred to the source line 153 and disappeared, and the charges QC required for charging the first capacitor portion CPA is $QC=2\times CE\times VP-CE\times VP=CE\times VP$. In other words, compared to the pixels with two switches connected in series (for example, the pixels PX1), the pixels with three switches connected in series (for example, the pixels PX2) may decrease a magnitude of a leakage current.

Figure 5:
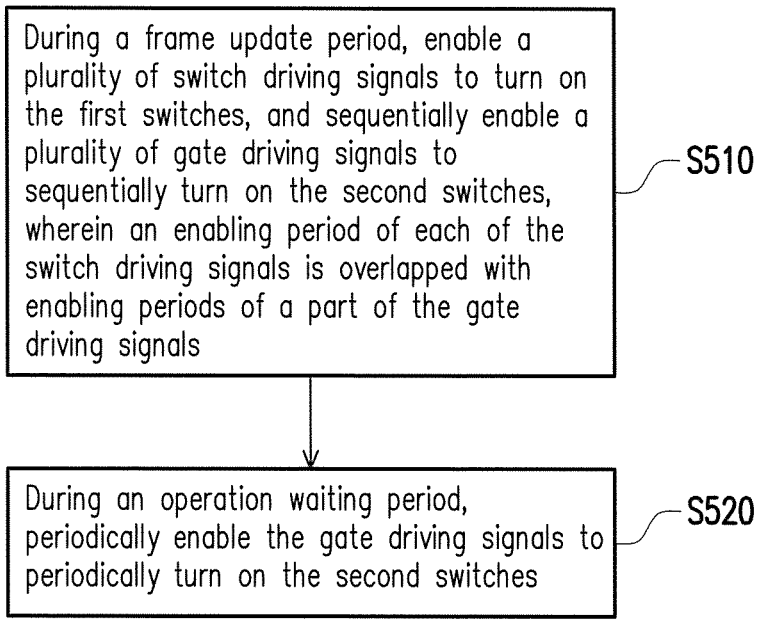
FIG. 5 is a flowchart illustrating a driving method of a display panel according to an embodiment of the invention.

FIG. 5 is a flowchart illustrating a driving method of a display panel according to an embodiment of the invention. Referring to FIG. 5, in the present embodiment, the display panel has a plurality of pixels arranged in an array, and each of the pixels has a first switch and a second switch connected in series. The driving method includes following steps. In step S510, during a frame update period, a plurality of switch driving signals is enabled to turn on the first switches, and a plurality of gate driving signals is sequentially enabled to sequentially turn on the second switches, where an enabling period of each of the switch driving signals is overlapped with enabling periods of a part of the gate driving signals. In step S520, during an operation waiting period, the gate driving signals are periodically enabled to periodically turn on the second switches. A sequence of the steps S510 and S520 is only an example, and the embodiment of the invention is not limited thereto. Moreover, details of the steps S510 and S520 may refer to the embodiments of FIG. 1, FIG. 2, FIG. 3 and FIG. 4A to FIG. 4C, and details thereof are not repeated.

In summary, in the display apparatus and the driving method of the display panel thereof, the switches in the pixel are periodically switched during the frame update period and the operation waiting period, so as to mitigate the stress phenomenon of the switch. Moreover, a leakage current of the pixel can be decreased by coupling three switches in series between the source line and the storage capacitor.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display apparatus, comprising:

a gate driving circuit, providing a plurality of gate driving signals;

a switch driving circuit, providing a plurality of switch driving signals; and a display panel, having a plurality of pixels arranged in an array, wherein each of the pixels comprises:

a first switch, a control terminal of the first switch receiving a first switch driving signal of the switch driving signals, and a first terminal of the first switch being coupled to a data line;

a second switch, a control terminal of the second switch receiving a first gate driving signal of the gate driving signals, and a first terminal of the second switch being coupled to a second terminal of the first switch; and a liquid crystal capacitor and a storage capacitor, coupled in parallel between a second terminal of the second switch and a common voltage, wherein during a frame update period, the gate driving signals are sequentially enabled, an enabling period of each of the switch driving signals is overlapped with enabling periods of a part of the gate driving signals, and a single enabling period of each of the switch driving signals is greater than an enabling period of one of the gate driving signals, and during an operation waiting period, the gate driving signals are periodically enabled.

2. The display apparatus as claimed in claim 1, wherein during the frame update period, the switch driving signals are simultaneously enabled.

3. The display apparatus as claimed in claim 1, wherein during the operation waiting period, the switch driving signals are simultaneously disabled.

4. The display apparatus as claimed in claim 1, wherein during the operation waiting period, the enabling periods of the gate driving signals are completely overlapped.

5. The display apparatus as claimed in claim 1, wherein each of the pixels further comprises a third switch, and a control terminal of the third switch receives the first switch driving signal, and the third switch is coupled between the second terminal of the second switch and the liquid crystal capacitor and the storage capacitor coupled in parallel.

6. The display apparatus as claimed in claim 1, wherein a frame update rate of the display panel is smaller than 30 Hz.

7. A driving method of a display panel, wherein the display panel has a plurality of pixels arranged in an array, and each of the pixels has a first switch and a second switch connected in series, the driving method comprising:

during a frame update period, enabling a plurality of switch driving signals to turn on the first switches, and sequentially enabling a plurality of gate driving signals to sequentially turn on the second switches, wherein an enabling period of each of the switch driving signals is overlapped with enabling periods of a part of the gate driving signals, and a single enabling period of each of the switch driving signals is greater than an enabling period of one of the gate driving signals; and during an operation waiting period, periodically enabling the gate driving signals to periodically turn on the second switches.

8. The driving method of the display panel as claimed in claim 7, further comprising:

during the frame update period, simultaneously enabling the switch driving signals.

9. The driving method of the display panel as claimed in claim 7, further comprising:

during the operation waiting period, simultaneously disabling the switch driving signals.

10. The driving method of the display panel as claimed in claim 7, wherein during the operation waiting period, the enabling period of the gate driving signals are completely overlapped.

11. The driving method of the display panel as claimed in claim 7, wherein a frame update rate of the display panel is smaller than 30 Hz.

* * * * *